US005960642A

United States Patent [19]

Kim et al.

[11] Patent Number: 5,960,642

[45] Date of Patent: Oct. 5, 1999

[54] REFRIGERATING CYCLE SYSTEM FOR A REFRIGERATOR

[75] Inventors: Kwang-Il Kim; Byung-Moo Lee; Eui-Joon Kim, all of Kyungki-Do, Rep. of Korea

[73] Assignee: Samsung Electronics Co., Ltd., Suwon, Rep. of Korea

[21] Appl. No.: 09/159,769

[22] Filed: Sep. 24, 1998

[30] Foreign Application Priority Data

Aug. 17, 1998 [KR] Rep. of Korea ..... 98-33221

[51] Int. Cl.[6] ..... F25B 5/04

[52] U.S. Cl. ..... 62/513; 62/197; 62/196.1; 62/198; 62/113

[58] Field of Search ..... 62/513, 197, 196.1, 62/198, 113

[56] References Cited

U.S. PATENT DOCUMENTS 5,406,805 4/1995 Radermacher et al. .

*Primary Examiner*—Henry Bennell
*Assistant Examiner*—Marc Norman
*Attorney, Agent, or Firm*—Burns, Doane, Swecker & Mathis, L.L.P.

[57] ABSTRACT

A refrigerating cycle system for a refrigerator has a freezing chamber and a refrigerating chamber. The refrigerating cycle system includes a compressor, a condenser, first and second expansion devices, a first evaporator for cooling the freezing chamber by evaporating the refrigerant that is reduced in pressure by the first and second expansion devices, and a second evaporator for cooling the refrigerating chamber. A fluid passage is provided for directly conducting the refrigerant from the condenser to the first evaporator. Another fluid passage is provided for directing the refrigerant from the condenser to the first evaporator via the second evaporator. A direction control valve is disposed between those two fluid passages to selectively direct the refrigerant to one of those fluid passages as a function of a sensed temperature of the refrigerating chamber.

2 Claims, 6 Drawing Sheets

REFRIGERATING CYCLE SYSTEM FOR A REFRIGERATOR

BACKGROUND OF THE INVENTION (1) Field of the Invention

The present invention relates to a refrigerator, and more particularly, to a refrigerating cycle system for a refrigerator, which can realize quick cooling during an initial operation of the refrigerator and maintain high efficiency during a normal operation of the refrigerator.

(2) Description of Related Art

Generally, a refrigerating cycle system used in a refrigerator or an air conditioner absorbs heat while a refrigerant is changed from a liquid phase into a vapor phase, and discharges the heat while the vapor phase is changed into the liquid phase. That is, the cooling operation is realized by heat exchange occurring when the phase of the refrigerant is changed.

U.S. Pat. No. 5,406,805 discloses a conventional refrigerating cycle system for a refrigerator. The refrigerating cycle system of this patent, as shown in the attached FIG. 1, comprises a compressor 20, a condenser 21, an expansion device 22, a first evaporator 23 for a freezing chamber, and a second evaporator 24 for a refrigerating chamber. These elements are connected in order by a cooling tube 25 to constitute a closed cycle. The first and second evaporators 23 and 24 and the condenser 21 are respectively provided with first, second and third air fans 23*a*, 24*a* and 21*a* so as to circulate air. The first and second evaporators 23 and 24 are interconnected in series so that the entirety of the refrigerant passing through the first evaporator 23 can flow into the second evaporator 24. The phase of the refrigerant is changed while flowing along the cooling tube 25 in a direction as indicated by arrows.

Describing more in detail, the refrigerant is evaporated while passing through the first and second evaporators 23 and 24 to absorb heat from the surrounding air, thereby generating cool air. The cool air is forced to the freezing and refrigerating chambers by the first and second air fans 23*a* and 24*a*.

FIG. 2 shows a detailed view of the second evaporator 24 for the refrigerating chamber. The second evaporator 24 is an intercooler evaporator comprising an inner tube 26*a* and an outer tube 26*b* enclosing the inner tube 26*a*. The refrigerant fed from the condenser 21 is supplied to the expansion device 22 through the inner tube 26*a* while the refrigerant fed from the first evaporator 23 is fed to the compressor 20 through the outer tube 26*b*. At this point, the refrigerant passing through the outer tube 26*b* is a two-phase refrigerant, which is a mixture of a liquid-phase refrigerant and a vapor-phase refrigerant. The two-phase refrigerant is used for a cooling process of the refrigerating chamber after flowing into the second evaporator 24 through the outer tube 26*b*. After this, the two-phase refrigerant is changed into the vapor-phase refrigerant and is then fed to the compressor 20. By using the above described intercooler evaporator, the refrigerant, which flows along the outer tube 26*b* of the second evaporator 24 after passing through the first evaporator 23, is used for cooling the refrigerating chamber as well as for sub-cooling the liquid refrigerant flowing along the inner tube 26*a* by a heat exchange. That is, since the liquid refrigerant fed to the expansion device 22 is sub-cooled by the heat exchange with the refrigerant flowing along the outer tube 26*b*, the efficiency of the refrigerating cycle system is increased.

However, the heat exchange between the high temperature liquid refrigerant from the condenser and the low temperature refrigerant passing through the first evaporator 23 occurs at the second evaporator 24, resulting in heat-load. As a result, the cooling performance of the refrigerating chamber is reduced. That is, when initially operating the refrigerator or reusing the same after being inactive for a long time, considerable time for lowering the temperature of the refrigerating chamber to a predetermined level is required. In addition, when there occurs a frequent opening of the refrigerator door which increases the temperature of the refrigerating chamber, it is impossible to rapidly reduce the temperature of the refrigerating chamber.

SUMMARY OF THE INVENTION

Therefore, the present invention has been made in an effort to solve the above-described problems.

It is an object of the present invention to provide a refrigerating cycle system that can realize quick cooling during an initial operation of the refrigerator and maintain high efficiency during a normal operation of the refrigerator.

To achieve the above object, the present invention provides a refrigerating cycle system for a refrigerator having a freezing chamber and a refrigerating chamber. The refrigerating cycle system includes a compressor, a condenser, a first evaporator for cooling the freezing chamber, and a second evaporator for cooling the refrigerating chamber. The second evaporator includes first and second conduits disposed in heat exchange relationship with one another. Each of the first and second conduits includes an inlet and an outlet. The inlet of the second conduit is connect to the outlet of the first evaporator, and the outlet of the second conduit is connected to the compressor. A third conduit conducts refrigerant from the condenser to the inlet of the first conduit. A fourth conduit conducts refrigerant from an outlet of the first conduit to an inlet of the first evaporator. A first expansion member is disposed in the fourth conduit. A fifth conduit conducts refrigerant from the condenser to the inlet of the first evaporator. A second expansion member is disposed in the fifth conduit. A control valve is provided for directing refrigerant from the condenser selectively to the third and fifth conduits.

BRIEF DESCRIPTION OF THE DRAWINGS

The accompanying drawings, which are incorporated in and constitute a part of the specification, illustrate a preferred embodiment of the invention, and, together with the description, serve to explain the principles of the invention.

DETAILED DESCRIPTION OF A PREFERRED EMBODIMENT

Reference will now be made in detail to a preferred embodiment of the invention, which is illustrated in the accompanying drawings. Wherever possible, the same reference numbers will be used throughout the drawings to refer to the same or like parts.

Figure 1:
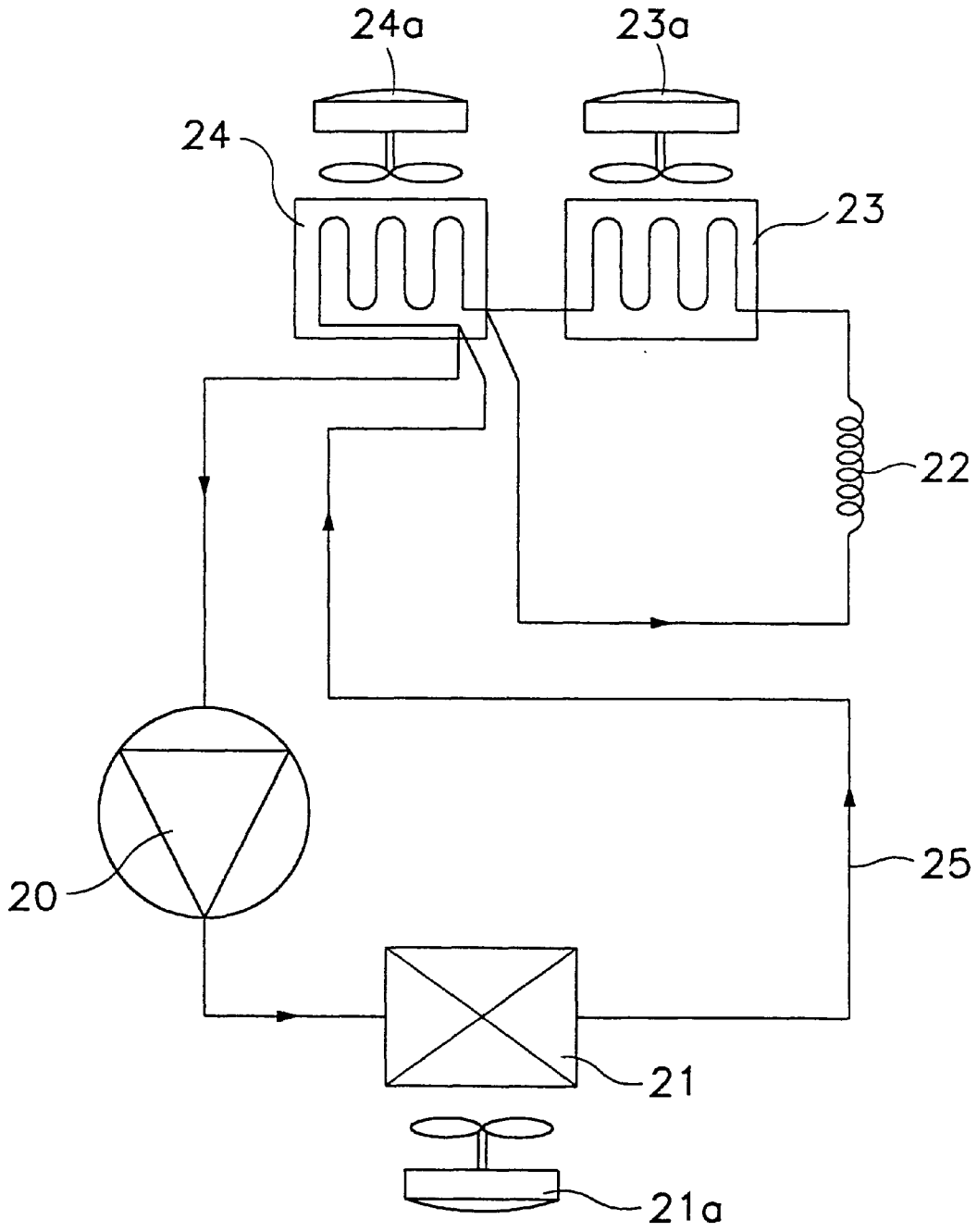
FIG. 1 (PRIOR ART)
FIG. 1 is a schematic view of a conventional refrigerating cycle system for a refrigerator.
Figure 2:
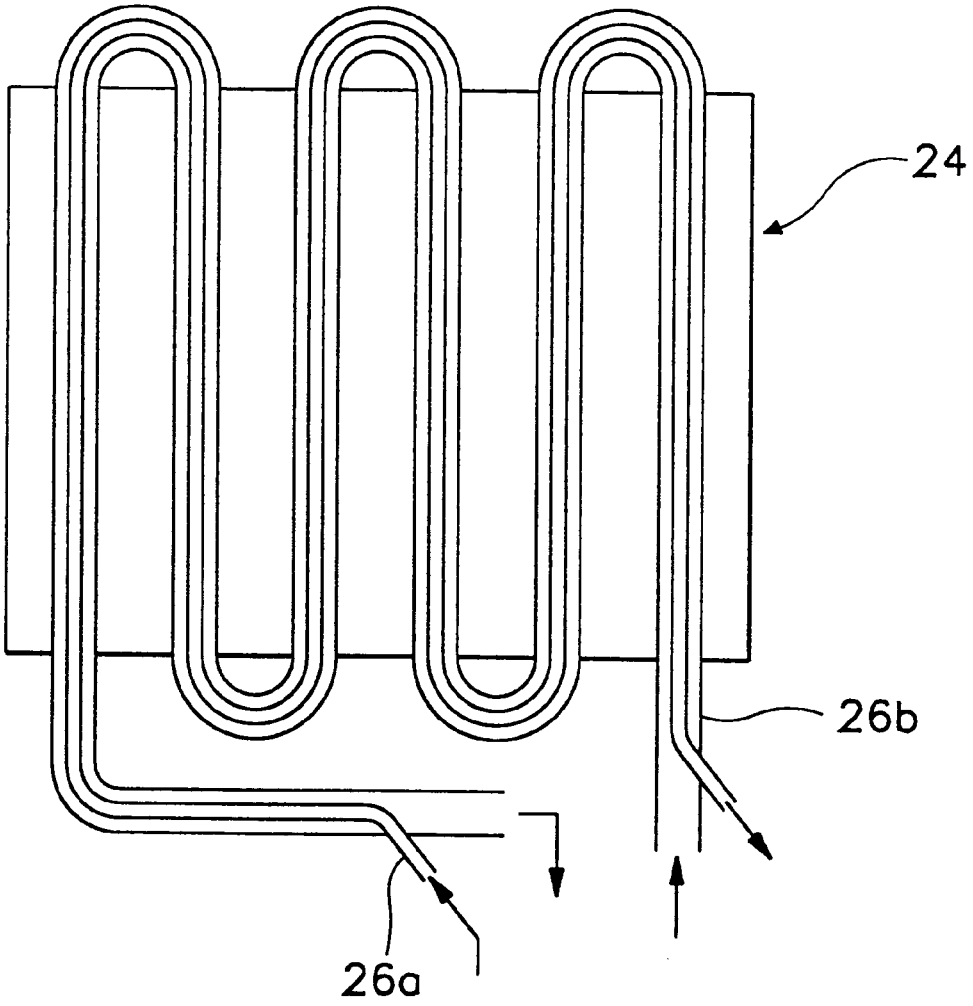
FIG. 2 (PRIOR ART)
FIG. 2 is a detailed view of an evaporator for a refrigerating chamber of FIG. 1.
Figure 3:
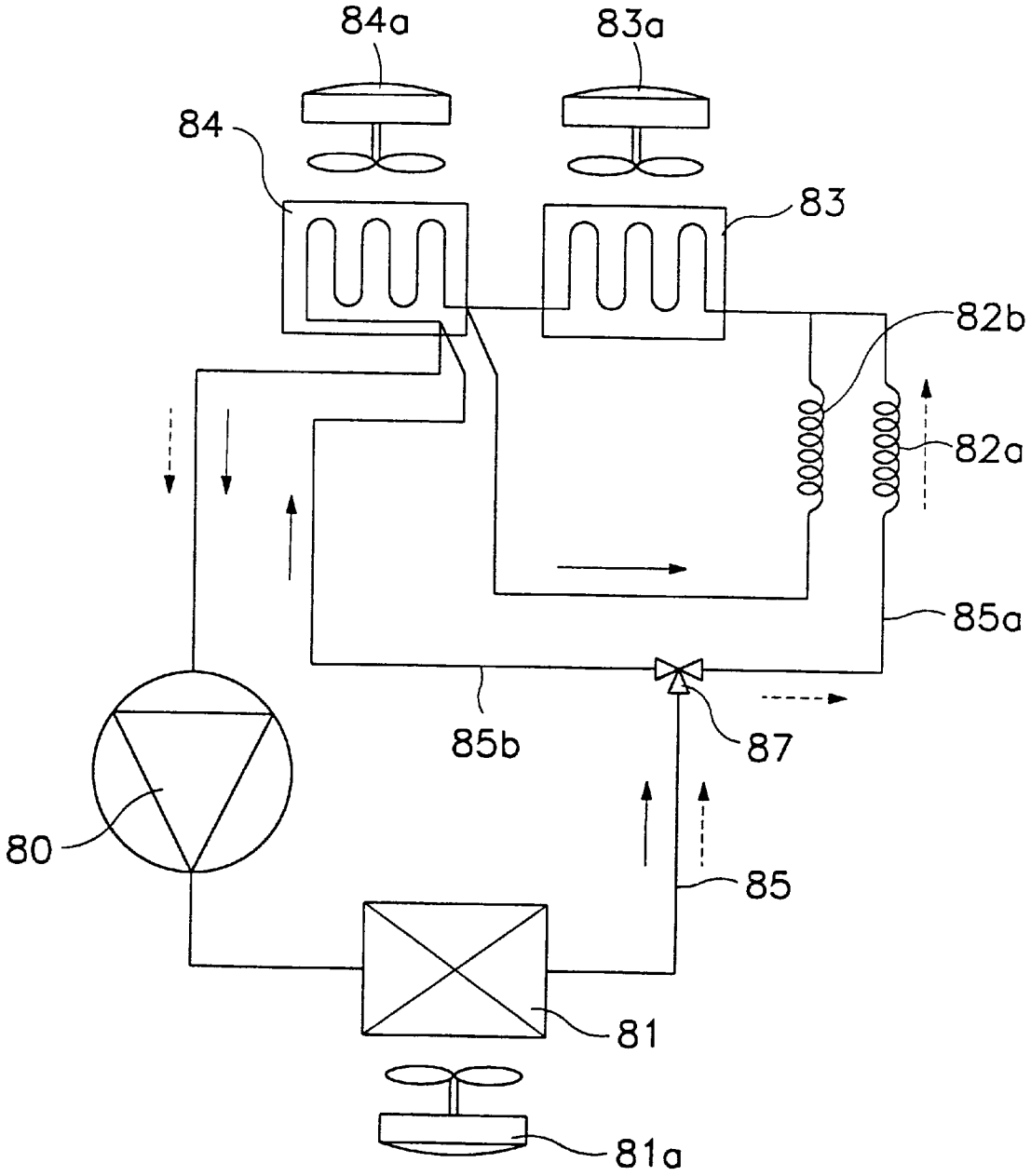
FIG. 3 is a schematic view of a refrigerating cycle system for a refrigerator according to a preferred embodiment of the present invention.

FIG. 3 shows a refrigerating cycle system for a refrigerator according to a preferred embodiment of the present invention. The inventive refrigerating cycle comprises a compressor 80, a condenser 81, first and second expansion devices 82*a* and 82*b*, a first evaporator 83 for a freezing chamber, and a second evaporator 84 for a refrigerating chamber. These elements are connected in order by a cooling tube 85 to constitute a closed cycle. The first and second evaporators 83 and 84 and the condenser 81 are respectively provided with first, second and third air fans 83*a*, 84*a* and 81*a* so as to cause air formed around them to be circulated. The first and second evaporators 83 and 84 are disposed in series so that the entirety of the refrigerant passing through the first evaporator 83 can flow into the second evaporator 84. The phase of the refrigerant changes while flowing along the cooling tube 85 in a direction as indicated by arrows.

Describing more in detail, the refrigerant is evaporated while passing through the first and second evaporators 83 and 84 to absorb heat from its surrounding air, thereby generating cool air. The cool air is forced to the freezing and refrigerating chambers by the first and second air fans 83*a* and 84*a*.

In addition, as a feature of the present invention, the cooling tube 85 connected to a downstream side of the condenser 81 is branched off into a first fluid passage 85*a* for directly conducting refrigerant from the condenser 81 to the first evaporator 83, and a second fluid passage 85*b* for directing refrigerant from the condenser 81 to the second evaporator 84.

There is provided a direction control valve 87 at a branch point of the first and second fluid passages 85*a* and 85*b* so that the refrigerant from the condenser 81 can be selectively directed to the first or second fluid passage 85*a* or 85*b*. This will be described more in detail hereinbelow.

The first expansion device 82*a* is disposed in the first fluid passage 85*a* between the condenser 81 and the first evaporator 83, and the second expansion device 82*b* is disposed in the second fluid passage 85*b* between the first and second evaporators 83 and 84.

Figure 4:
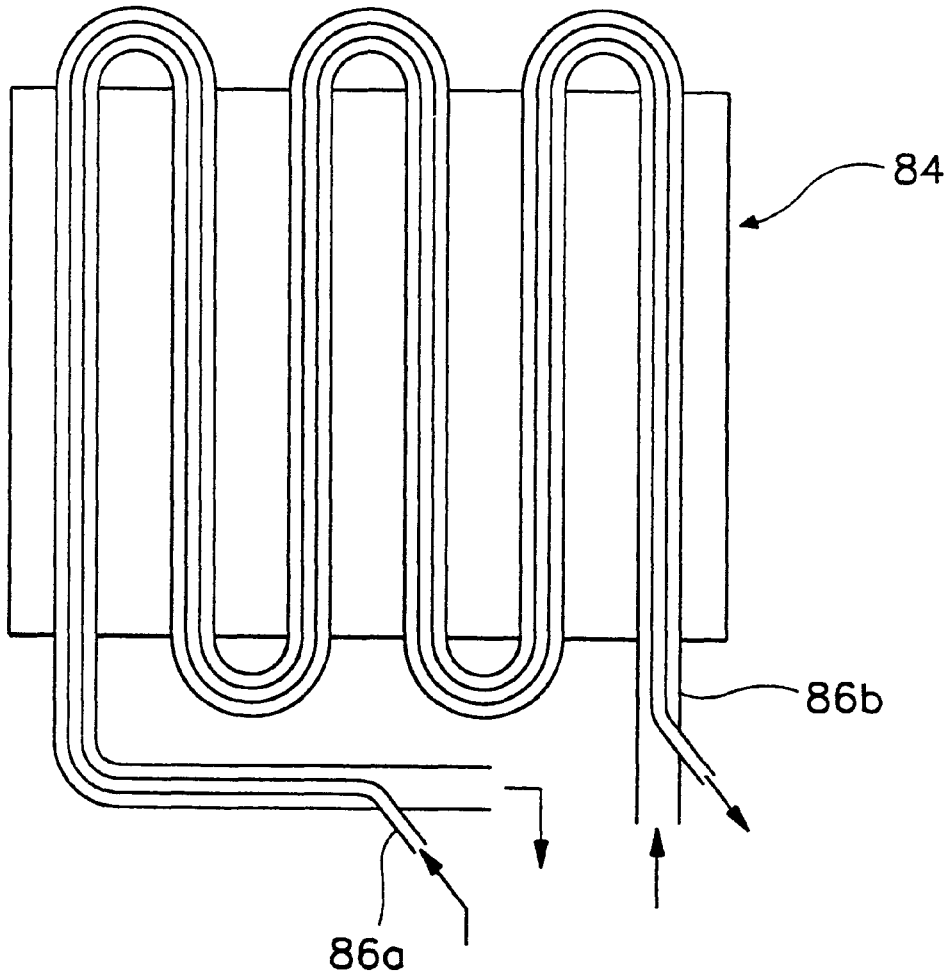
FIG. 4 is a detailed view of an evaporator for a refrigerating chamber of FIG. 3.

The second evaporator 84 is, as shown in FIG. 4, an intercooler evaporator comprising an inner tube 86*a*, and an outer tube 86*b* enclosing the inner tube 86*a*. The liquid refrigerant fed from the condenser 81 is supplied to the second expansion device 82*b* through the inner tube 86*a*, while the refrigerant fed from the first evaporator 83 is fed to the compressor 80 through the outer tube 86*b*. The refrigerant passing through the first evaporator 83 is a two-phase refrigerant that is a mixture of a liquid-phase refrigerant and a vapor-phase refrigerant. The two-phase refrigerant is used for a cooling process of the refrigerating chamber after flowing into the second evaporator 84 through the outer tube 86*b*. After this, the two-phase refrigerant is changed into a complete vapor-phase refrigerant and is then fed to the compressor 80. By using the above described intercooler evaporator, the refrigerant, which flows along the outer tube 86*b* of the second evaporator 84 after passing through the first evaporator 83, is used for cooling the refrigerating chamber as well as for subcooling the liquid refrigerant flowing along the inner tube 86*a* by a heat exchange. That is, since the liquid refrigerant fed to the second expansion device 82*b* has been subcooled by the heat exchange with the refrigerant flowing along the outer tube 86*b*, the efficiency of the refrigerating cycle system is increased.

Figure 5:
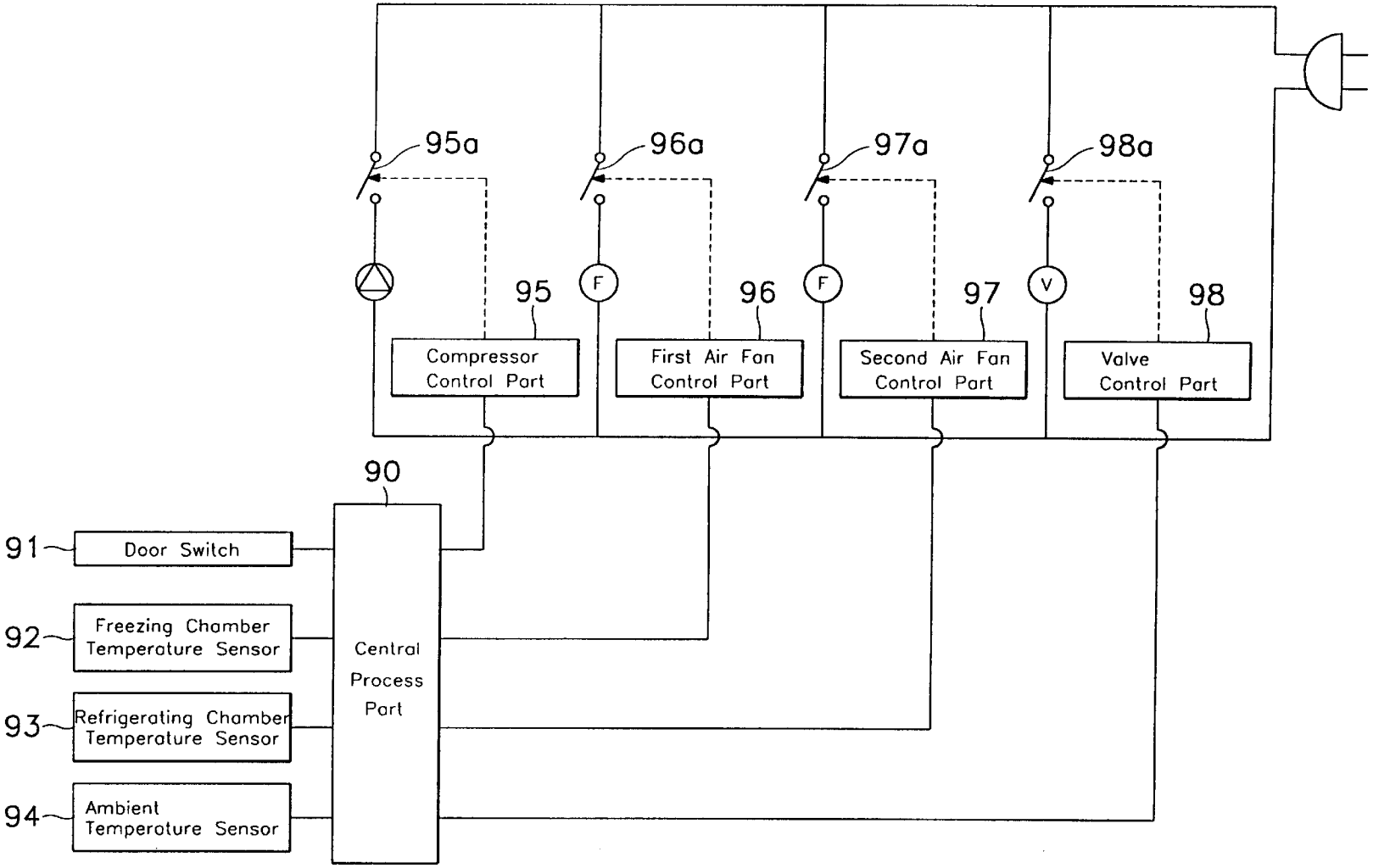
FIG. 5 is a block diagram of a control unit of a refrigerating cycle system according to a preferred embodiment of the present invention.

FIG. 5 shows a control unit of a refrigerating cycle system according to the preferred embodiment of the present invention.

The control unit comprises a central processor 90. And, there are provided a door switch 91, a freezing chamber temperature sensor 92, a refrigerating chamber temperature sensor 93, and an ambient temperature sensor 94, all of which are coupled to the input side of the central processor 90. The door switch 91 detects whether the refrigerator door is opened or closed and transmits the signals corresponding thereto to the central processor 90. The temperature sensors 92, 93 and 94 respectively detect temperatures of the freezing and refrigerating chambers and ambient air and transmit the electric signals corresponding thereto to the central processor 90. The control unit further comprises first, second, and third switches 95*a*, 96*a* and 97*a*, all of which are coupled to an output side of the central processor 90, for controlling the on/off state of the compressor 80, the first air fan 83*a* and the second air fan 84*a*, respectively. The first, second and third switches 95*a*, 96*a* and 97*a* are controlled by the central processor 90 via a compressor control part 95, a first air fan control part 96, and a second air fan control part 97 in response to the electric signals from the sensors 91, 92, 93 and 94, thereby individually controlling the compressor 80, the first air fan 83*a*, and the second air fan 84*a*.

In addition, coupled on the output side of the central processor 90 is a direction control switch 98*a* for controlling the direction control valve 87 via a valve control part 98. Therefore, the direction control valve 87 selectively directs the refrigerant fed from the condenser 81 to the first or second fluid passage 85*a* or 85*b* in response to the signals from the sensors 91, 92, 93 and 94.

The operation of the above-described refrigerating cycle system will be described hereinafter.

Generally, the freezing and refrigerating chambers are respectively designed to maintain temperatures of −15 to −21° C. and 6 to −1° C. These temperatures are respectively called a freezing chamber setting temperature and a refrigerating chamber setting temperature. Therefore, when initially operating the refrigerator or reusing the same after being inactive for a long time, the temperatures of the freezing and refrigerating chambers should be reduced to the setting temperatures as quickly as possible.

To achieve this, in the present invention, the freezing and refrigerating sensors 92 and 93 respectively detect the temperatures of the freezing and refrigerating chambers and transmit the signals corresponding thereto to the central processor 90. Particularly, when the temperature of the refrigerating chamber is above 10° C., the cooling performance should be enhanced. Therefore, in the present invention, the direction control valve 87 is controlled by the central processor 90 such that the refrigerant fed from the condenser 81 is directed to the first expansion device 82*a* along the first fluid passage 85*a*. The refrigerant passing through the first expansion device 82*a* is partly evaporated while passing through the first evaporator 83, and is then fed to the compressor 80 after being completely evaporated while passing through the second evaporator 84.

That is, the refrigerant absorbs heat from the ambient air while passing through the first and second evaporators 83 and 84, thereby cooling the air. This cool air is forced to the freezing and refrigerating chambers by the air fans 83*a* and 84*a* to reduce the temperatures of the freezing and refrigerating chambers to the respective setting temperatures.

When the refrigerating chamber gets to a normal operation state where the temperature thereof is maintained at the setting temperature, the central processor 90 controls the direction control valve 87 in response to a signal from the refrigerating temperature sensor 93 such that the refrigerant from the condenser 81 is directed to the second fluid passage 85*b*. Therefore, the refrigerant from the condenser 81 is subcooled while passing through the inner tube 86*a* of the intercooler evaporator 84, and is then fed to the first evaporator 83 via the second expansion device 82*b* to cool the freezing chamber. After this, the refrigerant returns to the compressor 80 through the outer tube 86*b* of the intercooler evaporator 84.

As described above, when a quick cooling of the refrigerator is not required, the refrigerating cycle system is designed to use the intercooler evaporator, thereby increasing the efficiency of the refrigerator to save electricity.

During the normal operation of the refrigerator, when the temperature of the refrigerating chamber is abruptly increased to above 10° C. due to frequent opening and closing of the refrigerating chamber door, the central processor 90 controls the direction control valve 87 in response to a signal from the refrigerating chamber temperature sensor 93 such that the refrigerant passes through the first fluid passage 85*a*, thereby realizing the quick cooling of the refrigerating chamber.

Figure 6:
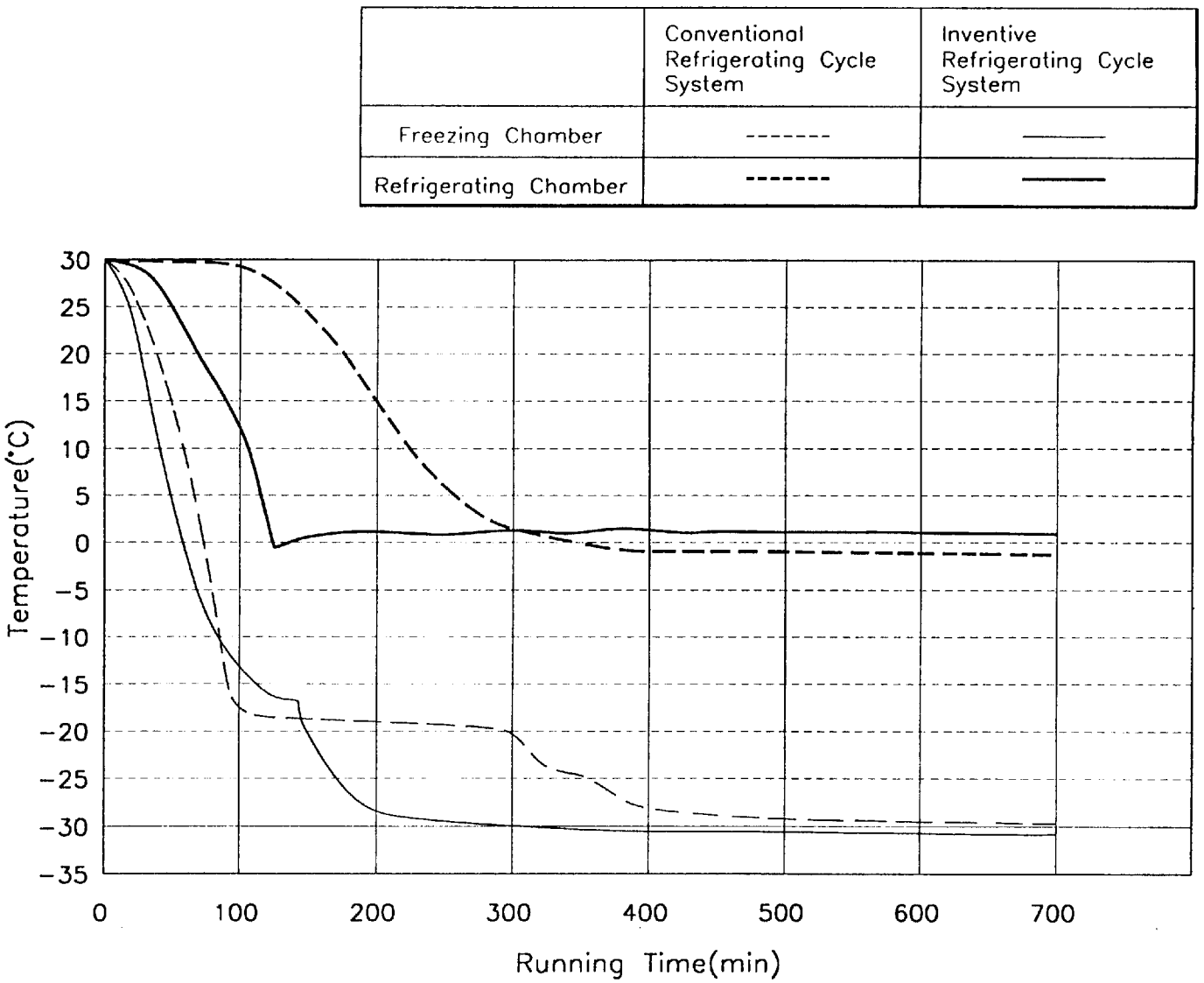
FIG. 6 is a graph illustrating initial cooling velocity of the inventive refrigerating cycle system and the conventional refrigerating cycle system.

FIG. 6 shows a graph comparing an initial cooling rate of a conventional refrigerating cycle system with that of the inventive refrigerating cycle system. The graph is attained through a test that was conducted in a room where the temperature and humidity were constant at 30° C. and 75%, respectively.

In the room, the doors of the freezing and refrigerating chambers were opened until the temperatures thereof were increased to 30° C. When the temperatures of the chambers got to 30° C., the doors were closed and the refrigerator was operated to measure a time for lowering the temperatures of the freezing and refrigerating chambers to −15° C. and 5° C., respectively.

It was learned that in the conventional cycle it took 97.5 minutes for the temperature of the freezing chamber to reach −15° C., and 268.5 minutes for the temperature of the refrigerating chamber to reach 5° C. However, in the inventive refrigerating cycle system, it took 117.5 minutes for the temperature of the freezing chamber to reach −15° C., and 114 minutes for the temperature of the refrigerating chamber to reach 5° C.

Although the initial cooling rate achieved by the inventive refrigerating cycle system in the freezing chamber was slightly lower than that of the prior art, the initial cooling rate achieved by the inventive refrigerating cycle system in the refrigerating chamber was significantly higher than that of the prior art, i.e., higher by 58%.

Also, when the frequent opening of the refrigerator door increases the temperature of the refrigerating chamber, it is possible to rapidly reduce the temperature of the refrigerating chamber.

While the particular process as herein shown and disclosed in detail is fully capable of obtaining the objects and advantages herein before stated, it is to be understood that it is merely illustrative of the presently preferred embodiments of the invention and that no design herein shown other than as described in the appended claims.

What is claimed is:

1. A refrigerating cycle system for a refrigerator having a freezing chamber and a refrigerating chamber, comprising:

a compressor for compressing refrigerant;

a condenser for condensing the refrigerant that is compressed by the compressor;

a first evaporator for cooling the freezing chamber;

a second evaporator for cooling the refrigerating chamber, the second evaporator including first and second conduits disposed in heat-exchange relationship with one another, each of the first and second conduits including an inlet and an outlet, the inlet of the second conduit connected to the outlet of the first evaporator, and the outlet of the second conduit connected to the compressor;

a third conduit for conducting refrigerant from the condenser to the inlet of the first conduit;

a fourth conduit for conducting refrigerant from an outlet of the first conduit to an inlet of the first evaporator;

a first expansion member disposed in the fourth conduit;

a fifth conduit for conducting refrigerant from the condenser to the inlet of the first evaporator;

a second expansion member disposed in the fifth conduit; and a control valve for directing refrigerant from the condenser selectively to the third and fifth conduits.

2. The refrigerating cycle according to claim 1 further including a temperature sensor for sensing a temperature in the refrigerating chamber, a controller connected to the control valve and the temperature sensor for actuating the control valve to supply refrigerant from the condenser to the third conduit when a sensed temperature in the refrigerating chamber is below a reference valve, and to supply refrigerant from the condenser to the firth conduit when a sensed temperature in the refrigerating chamber is above a reference valve.

* * * * *